US011622616B2

(12) United States Patent
Li et al.

(10) Patent No.: US 11,622,616 B2
(45) Date of Patent: Apr. 11, 2023

(54) WRIST-WORN DEVICE

(71) Applicant: GOERTEK INC., Shandong (CN)

(72) Inventors: Xingyu Li, Shandong (CN); Xiaodong Liu, Shandong (CN); Xiangxiang Liu, Shandong (CN); Jinfeng Li, Shandong (CN)

(73) Assignee: GOERTEK INC., Shandong (CN)

( * ) Notice: Subject to any disclaimer, the term of this patent is extended or adjusted under 35 U.S.C. 154(b) by 59 days.

(21) Appl. No.: 17/433,200

(22) PCT Filed: Dec. 4, 2019

(86) PCT No.: PCT/CN2019/122839
§ 371 (c)(1),
(2) Date: Aug. 23, 2021

(87) PCT Pub. No.: WO2021/042604
PCT Pub. Date: Mar. 11, 2021

(65) Prior Publication Data

US 2022/0117381 A1 Apr. 21, 2022

(30) Foreign Application Priority Data

Sep. 6, 2019 (CN) ..... 201910843090.3

(51) Int. Cl.
*A44C 5/00* (2006.01)
*A45C 11/00* (2006.01)
(Continued)

(52) U.S. Cl.
CPC ..... *A45F 5/00* (2013.01); *A44C 5/003* (2013.01); *A45C 11/00* (2013.01); *H04R 1/1016* (2013.01);
(Continued)

(58) Field of Classification Search
CPC .. H04R 1/1016; A44C 5/003; A45C 2011/001
See application file for complete search history.

(56) References Cited

U.S. PATENT DOCUMENTS

2015/0107300 A1 4/2015 Chan
2017/0041702 A1 2/2017 Bae et al.

FOREIGN PATENT DOCUMENTS

CN 104038859 A 9/2014
CN 104544797 A 4/2015
(Continued)

OTHER PUBLICATIONS

International Search Report, English Translation, from PCT/CN2019/122839 filed Dec. 4, 2019, dated May 28, 2020.

*Primary Examiner* — Justin M Larson
(74) *Attorney, Agent, or Firm* — Workman Nydegger

(57) ABSTRACT

A wrist-worn device is provided, which includes a device main body and an earphone. An accommodating groove for placing the earphone is provided on the device main body, a key is slidably mounted on one of the device main body and fee earphone. A clamping groove is provided on the other one of the device main body and the earphone, and a snapin head cooperating with the clamping groove is provided at a top of the key. The key is provided with a first attraction portion, the device main body or the earphone having the clamping groove is provided with a second attraction portion, and the first attraction portion is magnetically attracted with the second attraction portion in a case that the key slides forward until the snapin head is inserted into the clamping groove.

18 Claims, 4 Drawing Sheets

(51) Int. Cl.
*H04R 1/10* (2006.01)
*A45F 5/00* (2006.01)

(52) U.S. Cl.
CPC ... *A45C 2011/001* (2013.01); *A45F 2005/008* (2013.01); *A45F 2200/0508* (2013.01)

(56) References Cited

FOREIGN PATENT DOCUMENTS

| | | | | | |
|---|---|---|---|---|---|
| CN | 206061067 | U | | 3/2017 | |
| CN | 206453365 | U | | 9/2017 | |
| CN | 107249151 | A | | 10/2017 | |
| CN | 206866761 | U | | 1/2018 | |
| CN | 208316964 | U | | 1/2019 | |
| CN | 208822482 | U | | 5/2019 | |
| CN | 110134193 | A | | 8/2019 | |
| CN | 209201298 | U | | 8/2019 | |
| CN | 110301721 | A | * | 10/2019 | ..... A44C 5/0007 |
| CN | 110507042 | A | | 11/2019 | |
| CN | 109076276 | B | | 12/2019 | |
| CN | 111685455 | A | * | 9/2020 | |
| CN | 211909091 | U | * | 11/2020 | ..... A44C 5/003 |
| EP | 3627501 | A4 | * | 7/2021 | ..... G06F 1/163 |
| EP | 3879844 | A1 | * | 9/2021 | ..... A44C 5/003 |
| WO | WO-2021215908 | A1 | * | 10/2021 | |

* cited by examiner

WRIST-WORN DEVICE

The present application is a National Stage application of PCT international patent application PCT/CN2019/122839, filed on Dec. 4, 2019, which claims the priority to Chinese Patent Application No. 201910843090.3, titled "WRIST-WORN DEVICE", with the China National Intellectual Property Administration filed on Sep. 6, 2019, both of which are incorporated herein by reference in their entirety.

FIELD

The present application relates to the technical field of wearable devices, and in particular to a wrist-worn device.

BACKGROUND

Nowadays, there are more and more wireless earphones and wrist-worn devices on the market, and these electronic products have their own functions and advantages. A wireless earphone, such as a TWS earphone, can be used to listen to music, make a phone call, etc., however, it can only be attached to other mobile phone or computer with a Bluetooth device. A wrist-worn device, such as a bracelet and a watch, has relatively conventional functions, such as measuring heart rate, timing, etc.

With the diversified requirements of people for the function of the bracelet and the watch, a product combining the wireless earphone with the wrist-worn device such as the bracelet and the watch has begun to appear. However, taking out and storing of the wireless earphone has become a new technical difficulty. Therefore, how to reliably place the earphone to prevent accidental falling and conveniently take out the earphone is a problem that needs to be solved by those skilled in the art.

SUMMARY

In view of this, an object according to the present application is to provide a wrist-worn device, and a structural design of the wrist-worn device can effectively solve the problem that an earphone is difficult to be reliably stored and inconvenient to take out in the wrist-worn device.

In order to achieve the first object, the following technical solution is provided according to the present application:

a wrist-worn device, which includes a device main body and an earphone. An accommodating groove for placing the earphone is provided on the device main body, a key is slidably mounted on one of the device main body and the earphone, a clamping groove is provided on the other one of the device main body and the earphone, a snapin head cooperating with the clamping groove is provided at a top of the key, the key is provided with a first attraction portion, the device main body or the earphone which has the clamping groove is provided with a second attraction portion, and the first attraction portion is magnetically attracted with the second attraction portion in a case that the key slides forward until the snapin head is inserted into the clamping groove.

Preferably, in the above wrist-worn device, the first attraction portion is a first magnet, a second magnet is provided on a position of the device main body or the earphone which has the clamping groove, the position is located behind the second attraction portion and corresponds to the key sliding backward until the snapin head exits the clamping groove, and a magnetic pole of an end of the second magnet is the same as a magnetic pole of an end of the first magnet opposite to the second magnet to generate a repulsive force to push the earphone out of the accommodating groove.

Preferably, in the above wrist-worn device, the clamping groove or the key is provided on one end of the earphone, a third attraction portion is provided on the other end of the earphone, the device main body is provided with a fourth attraction portion corresponding to the third attraction portion for magnetic attraction with the third attraction portion, the third attraction portion is located on an inner side surface of the earphone, and the fourth attraction portion is located at a groove bottom of the accommodating groove, and an outer side surface of the fourth attraction portion facing the third attraction portion is an inclined surface inclined toward the third attraction portion from back to front.

Preferably, in the above wrist-worn device, the third attraction portion is a third magnet, the fourth attraction portion is a fourth magnet, and a magnetic pole of an inner side surface of the third magnet is opposite to a magnetic pole of an outer side surface of the fourth magnet.

Preferably, in the above wrist-worn device, the second attraction portion is a fifth magnet, and a magnetic pole of an end of the first magnet is opposite to a magnetic pole of an end of the fifth magnet opposite to the first magnet.

Preferably, in the above wrist-worn device, an elastic member is arranged between the key and the device main body or the earphone which is mounted with the key, and the elastic member is deformed in a case that the key moves backward and generates a restoring force to keep the snapin head in a pushed-out state.

Preferably, in the above wrist-worn device, a sliding groove is provided in the device main body or the earphone, the key includes a key body and a sliding block fixedly connected to the key body, the sliding block is located in the sliding groove, the key body is mounted on a surface of the device main body or the earphone, the snapin head is located at a top end of the sliding block, and a through hole for the snapin head to pass through is provided at a top end of the sliding groove.

Preferably, in the above wrist-worn device, the elastic member is a compressed elastic member with one end of the compressed elastic member abutting against a bottom end of the sliding groove and the other end of the compressed elastic member abutting against a bottom end of the sliding block.

Preferably, in the above wrist-worn device, the accommodating groove is arranged on a side wall of the device main body in a length direction of the device main body.

Preferably, the above wrist-worn device includes two of the earphones, the accommodating groove, the key and the clamping groove are provided in cooperation with each of the two earphones.

The wrist-worn device provided according to the present application includes the device main body and the earphone. The accommodating groove for placing the earphone is provided on the device main body, the key is slidably mounted on one of the device main body and the earphone, and the clamping groove and the second attraction portion are provided on the other one of the device main body and the earphone. The snapin head for cooperating with the clamping groove is provided at the top of the key. The key is provided with the first attraction portion, and the first attraction portion is magnetically attracted with the second attraction portion in a case that the key slides forward until the snapin head is inserted into the clamping groove.

In a case that the wrist-worn device provided according to the present application is applied, when a user does not need to use the earphone, the earphone can be placed in the accommodating groove, the key slides forward to insert the snapin head into the clamping groove, so that the earphone is connected to the device main body. Besides, the first attraction portion is magnetically attracted with the second attraction portion, which plays a role of connecting the earphone with the device main body. In addition, the key is locked at a position by the magnetic attraction effect, which keeps the snapin head inserted into the clamping groove, and realizes the reliable connection between the earphone and the device main body. When the earphone needs to be used, the external force overcomes the magnetic force between the first attraction portion and the second attraction portion and pushes the key to slide backward, and the snapin head moves backward accordingly to exit the clamping groove, the connection between the earphone and the device main body is released to take out the earphone. It can be seen that, by using the wrist-worn device, the earphone can be not only reliably stored and prevented from accidentally falling, but also be taken out by sliding the key, which has a simple and convenient operation.

BRIEF DESCRIPTION OF THE DRAWINGS

For more clearly illustrating embodiments of the present application or the technical solutions in the conventional technology, drawings to be used in the description of the embodiments or the conventional technology will be briefly described hereinafter. Apparently, the drawings in the following description are only some embodiments of the present application. For those skilled in the art, other drawings may be obtained based on the provided drawings without any creative work.

Figure 1:
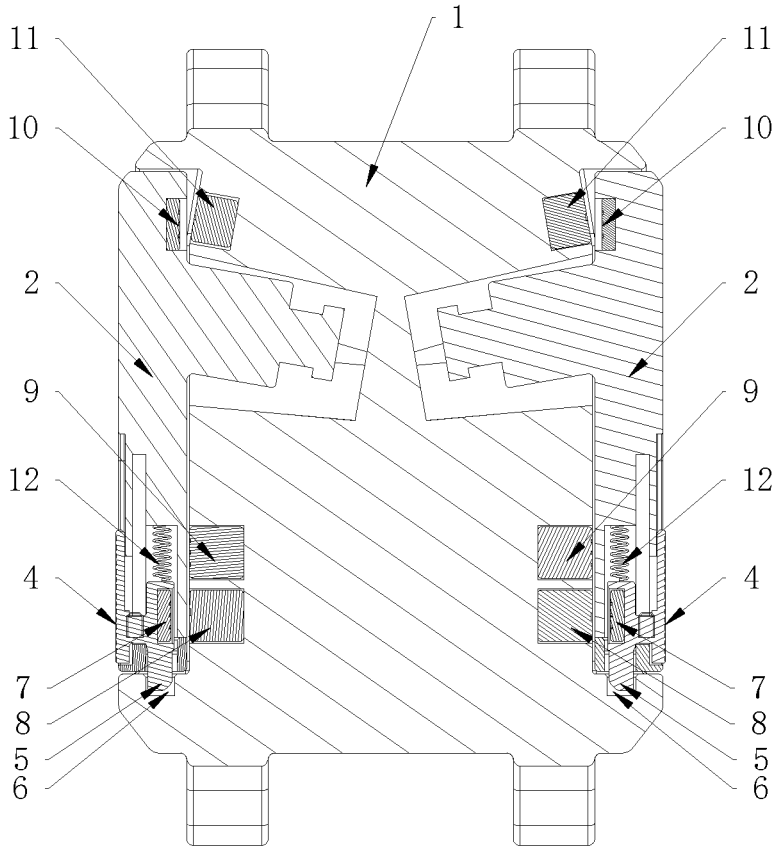
FIG. 1 is a schematic sectional view of an earphone of a wrist-worn device in a stored state according to a specific embodiment of the present application.

Reference numerals in the figures are as follows:

| | |
|---|---|
| 1 device main body, | 2 earphone, |
| 3 accommodating groove, | 4 key, |
| 5 snapin head, | 5 clamping groove, |
| 7 first attraction portion, | 8 second attraction portion, |
| 9 second magnet, | 10 third attraction portion, |
| 11 fourth attraction portion, | 12 elastic member, |
| 41 key body, | 42 sliding block, |
| 43 end plug. | |

DETAILED DESCRIPTION OF THE EMBODIMENTS

A wrist-worn device is provided according to the present application, so as to reliably store and conveniently take out an earphone.

The technical solutions according to the embodiments of the present application will be described clearly and completely as follows in conjunction with the drawings in the embodiments of the present application. It is apparent that the described embodiments are only a part of the embodiments according to the present application, rather than all of the embodiments. Based on the embodiments of the present application, all other obtained without creative efforts by those of the ordinary skill in the art shall fall within the protection scope of the present application.

Figure 2:
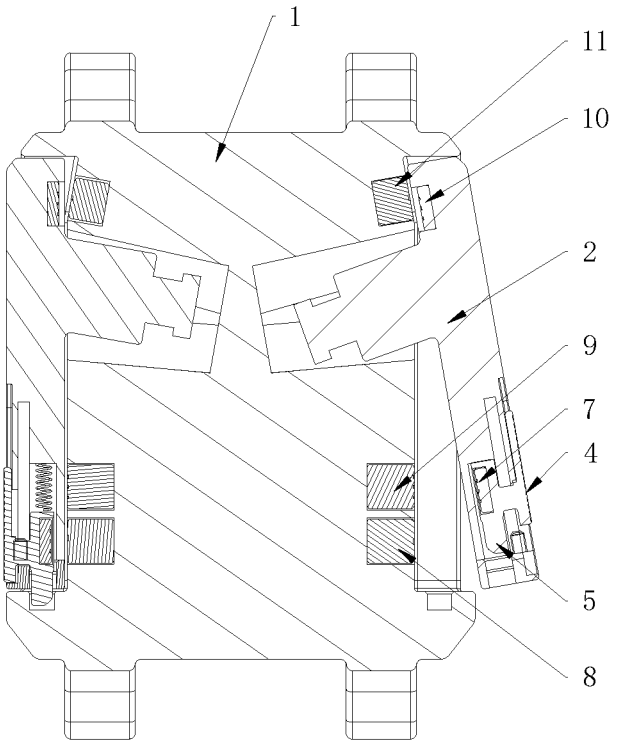
FIG. 2 is a schematic sectional view of the earphone corresponding to FIG. 1 in a pop-up state.
Figure 3:
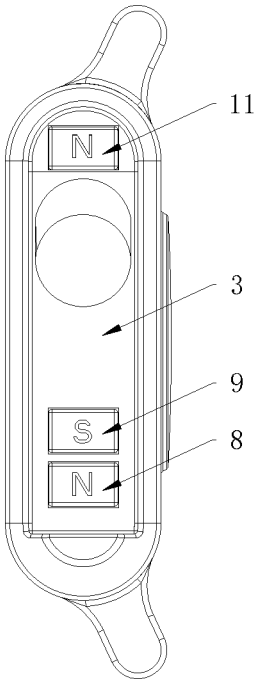
FIG. 3 is a schematic side view of a device main body in FIG. 1.
Figure 4:
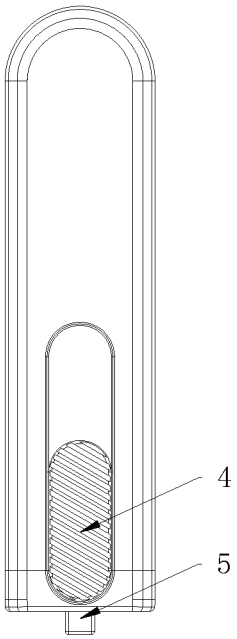
FIG. 4 is a schematic structural view showing one side of the earphone in FIG. 1.
Figure 5:
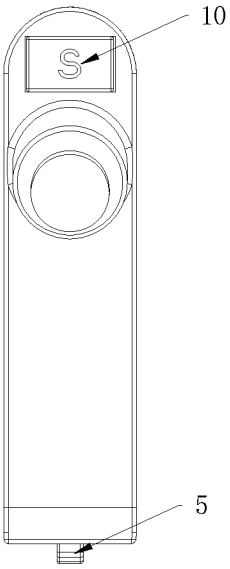
FIG. 5 is a schematic structural view showing another side of FIG. 4.
Figure 6:
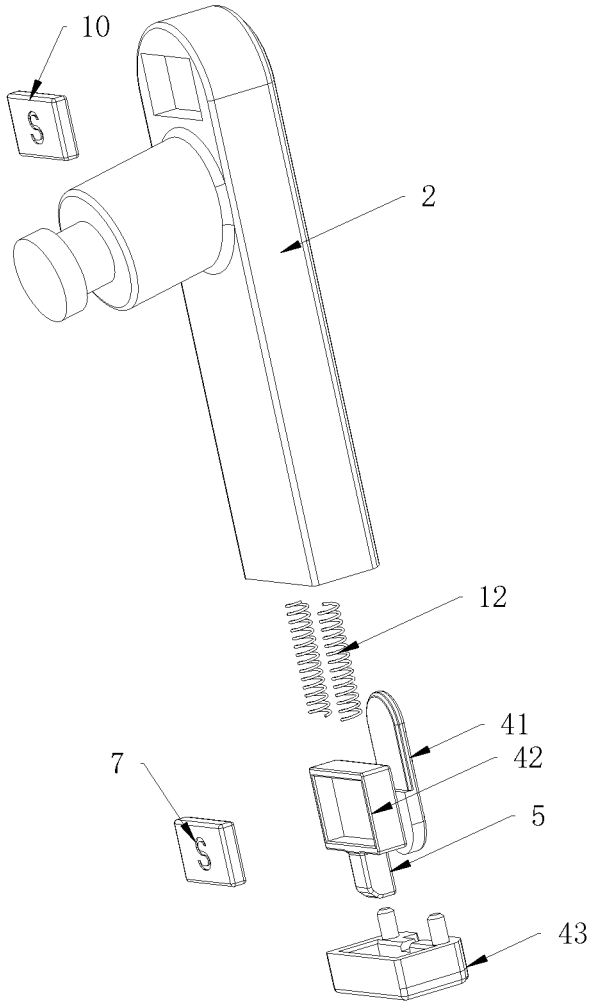
FIG. 6 is a schematic exploded view of FIG. 4.

Referring to FIGS. 1 to 6, FIG. 1 is a schematic sectional view of an earphone of a wrist-worn device in a stored state according to a specific embodiment of the present application; FIG. 2 is a schematic sectional view of the earphone corresponding to FIG. 1 in a pop-up state; and FIG. 3 to FIG. 6 are specific schematic structural views of members in FIG. 1.

In a specific embodiment, the wrist-worn device provided according to the present application includes a device main body 1 and an earphone 2.

An accommodating groove 3 for placing the earphone 2 is provided on the device main body 1 to place the earphone 2. The device main body 1 is a main structure of the wrist-worn device, and in a case that the wrist-worn device is a watch, the device main body 1 is a watch main body, which may specifically include a display screen. A specific structure of the device main body 1 may refer to the conventional technology, which is not repeated here. A wearing member of the wrist-worn device for the user may be a belt body fixedly connected to the device main body 1, or a hook fixedly connected to the device main body 1 for hooking on clothes of the user, which can refer to the corresponding structure of the conventional wrist-worn device, and is not specifically limited here. A specific shape of the accommodating groove 3 may be arranged according to a shape of the earphone 2, and is preferably arranged in a profile of the earphone 2.

The earphone 2 may be specifically used for audio playback or voice call, and its structure and working principle for realizing the function can refer to the conventional technology, which is not repeated here. The earphone 2 is preferably a wireless earphone 2, such as a TWS earphone, which is convenient for use. The earphone 2 may be a conventional wired earphone 2 as required, and an earphone cable is placed in the accommodating groove 3 accordingly.

A key 4 is slidably mounted on one of the device main body 1 and the earphone 2, and a clamping groove 6 and a second attraction portion 8 are provided on the other one of the device main body 1 and the earphone 2. That is, the key 4 can be slidably mounted on the earphone 2, and the clamping groove 6 and the second attraction portion 8 can be provided on the device main body 1, or the key 4 can be slidably mounted on the device main body 1, and the clamping groove 6 and the second attraction portion 8 can be provided on the earphone 2. In order to facilitate description, the drawings are described by taking an example that the key 4 is slidably mounted on the earphone 2, and the clamping groove 6 and the second attraction portion 8 are provided on the device main body 1.

A snapin head 5 is provided at a top of the key 4, and the snapin head 5 is configured to cooperate with the clamping groove 6. It should be noted that the top of the key 4 refers to an end of the key 4 in a direction of the snapin head 5 inserted into the clamping groove 6. The earphone 2 is connected to the device main body 1 by inserting the snapin head 5 into the clamping groove 6, and the earphone 2 is stored in the accommodating groove 3. A structure of the snapin head 5 is cooperated with a structure of the clamping groove 6. Specifically, a protrusion may be provided at the top of the key 4 as the snapin head 5, and the clamping groove 6 may be arranged in profile of the protrusion.

The key 4 is provided with a first attraction portion 7, and the first attraction portion 7 is magnetically attracted with the second attraction portion 8 in a case that the key 4 slides forward until the snapin head 5 is inserted into the clamping groove 6. As in the embodiment shown in FIG. 1, the key 4 is provided with the first attraction portion 7, the device main body 1 is provided with the second attraction portion 8, and a position of the second attraction portion 8 is opposite to a position of the first attraction portion 7 in a case that the key 4 slides forward until the snapin head 5 is inserted into the clamping groove 6, so that the first attraction portion 7 is magnetically attracted with the second attraction portion 8, and a position of the key 4 is locked. It should be noted that, the first attraction portion 7 and the second attraction portion 8 may specifically arranged such that one adopts a magnet, the other adopts a member made of a material which can be magnetized such as iron, cobalt or nickel, or both the first attraction portion 7 and the second attraction portion 8 may adopt magnets. In a case that both the first attraction portion 7 and the second attraction portion 8 use magnets, the magnetic attraction is strong, so that the earphone 2 can be reliably stored in the device main body 1 and is not easy to fall off.

In a case that the wrist-worn device provided according to the present application is applied, when the user does not need to use the earphone 2, the earphone 2 can be placed in the accommodating groove 3, the key 4 slides forward to insert the snapin head 5 into the clamping groove 6, so that the earphone 2 is connected to the device main body 1. Besides, the first attraction portion 7 is magnetically attracted with the second attraction portion 8, which plays a role of connecting the earphone 2 with the device main body 1. In addition, the key 4 is locked at the position by the magnetic attraction effect, which keeps the snapin head 5 inserted into the clamping groove 6, and realizes the reliable connection between the earphone 2 and the device main body 1. When the earphone 2 needs to be used, the external force overcomes the magnetic force between the first attraction portion 7 and the second attraction portion 8 and pushes the key 4 to slide backward, and the snapin head 5 moves backward accordingly to exit the clamping groove 6, the connection between the earphone 2 and the device main body 1 is released to take out the earphone 2. It can be seen that, by using the wrist-worn device, the earphone 2 can be not only reliably stored and prevented from accidentally falling, but also be taken out by sliding the key 4, which has a simple and convenient operation.

Specifically, the first attraction portion 7 is a first magnet, a second magnet 9 is provided on a position of the device main body 1 or the earphone 2 having the clamping groove 6, the position is located behind the second attraction portion 8 and corresponds to the key 4 sliding backward until the snapin head 5 exits the clamping groove 6, and a magnetic pole of an end of the second magnet 9 is the same as a magnetic pole of an end of the first magnet opposite to the second magnet 9 to generate a repulsive force to push the earphone 2 out of the accommodating groove 3. It should be noted that, the backward is opposite to the forward described hereinafter, and a direction of the snapin head 5 inserted into the clamping groove 6 is taken as the forward, and a direction of the snapin head 5 away from the clamping groove 6 is taken as the backward. In FIG. 1, the key 4 slides forward, that is, the key 4 slides downward in FIG. 1. Taking the key 4 mounted on the earphone 2 as an example, the second magnet 9 is arranged behind the second attraction portion 8 on the device main body 1, and the position of the second magnet 9 is opposite to the position of the first magnet in a case that the key 4 slide backward until the snapin head 5 exits the clamping groove 6. The magnetic pole of the end of the second magnet 9 is the same as the magnetic pole of the first magnet opposite to the second magnet 9, that is, in a case that the key 4 slides backward until the snapin head 5 exits the clamping groove 6, the magnetic pole of the end of the first magnet is the same as the magnetic pole of the second magnet 9 opposite to the first magnet. If a side surface of the first magnet facing the second magnet 9 is an N pole, a side surface of the second magnet 9 facing the first magnet is also an N pole, or both the side surfaces are S poles.

Since the magnetic pole of the end of the first magnet is the same as the magnetic pole of the second magnet 9 opposite to the first magnet, the generated repulsive force pushes the earphone 2 out of the accommodating groove 3, so as to facilitate the taking of the earphone 2. In addition, in a stored state of the earphone 2, that is, in a state of the snapin head 5 inserted into the clamping groove 6, when the key 4 slides backward, the key 4 has a returning trend due to the mutual repulsion effect of the same magnetic poles of the first magnet and the second magnet 9. Therefore, the locking of the key 4 is more reliable, and the connection of the earphone 2 and the device main body 1 is more reliable, which further reduces the risk of falling out of the earphone 2 due to an accidental touch.

In a case that the key 4 is arranged on the earphone 2, that is, the first magnet is arranged on the earphone 2, the first magnet may be arranged on an inner side surface of the earphone 2, and the second magnet 9 may be located on a groove bottom of the accommodating groove 3. It should be noted that, the inner side surface of the earphone 2 refers to a side surface opposite to the groove bottom of the accommodating groove 3 when the earphone 2 is placed in the accommodating groove 3. The groove bottom of the accommodating groove 3 is a bottom in a placed direction when the earphone 2 is placed in the accommodating groove 3. As shown in FIG. 1, the inner side surface of the earphone 2 is a left side surface of a right earphone 2 and a right side surface of a left earphone 2. With the above arrangement, in a case that the external force pushes the key 4 to slide backward to allow the snapin head 5 to be separated from the clamping groove 6 and a first magnetic member to be opposite to a second magnetic member, the repulsive force between the first magnetic member and the second magnetic member ejects the earphone 2 out of the accommodating groove 3, which facilitates the taking for the user. In a case that the key 4 is arranged on the device main body 1, that is, the first magnet is arranged on the device main body 1, and the second magnet 9 may be arranged on an outer side surface of the earphone 2. An avoidance area for the snapin head 5 when the earphone 2 ejects out of the accommodating groove 3 is accordingly provided on the inner side surface of the earphone 2. A position of the first magnet and the second magnet 9 may be adjusted accordingly, as long as a direction of the repulsive force generated by the opposite sides of the first magnet and the second magnet 9 and received by the earphone 2 is opposite to a direction of the earphone 2 placed in the accommodating groove 3.

Further, the clamping groove 6 or the key 4 is provided on one end of the earphone 2, a third attraction portion 10 is provided on the other end of the earphone 2, the device main body 1 corresponding to the third attraction portion 10 is provided with a fourth attraction portion 11 for magnetic attraction with the third attraction portion 10, the third attraction portion 10 is located on the inner side surface of the earphone 2, and the fourth attraction portion 11 is located at the groove bottom of the accommodating groove 3, and an outer side surface of the fourth attraction portion 11 facing the third attraction portion 10 is an inclined surface and is inclined toward the third attraction portion 10 from back to front. Taking the key 4 provided on the earphone 2 as an example, the end of the earphone 2 is provided with the key 4, which is also provided with the first magnet, and the other end is provided with the third attraction portion 10. The device main body 1 is provided with the fourth attraction portion 11, the third attraction portion 10 is magnetically attracted with the fourth attraction portion 11, and the outer side surface of the fourth attraction portion 11 facing the third attraction portion 10 is the inclined surface inclined toward the third attraction portion 10 from back to front. A front end of the fourth attraction portion 11 does not contact the inner side surface of the earphone 2 when the earphone 2 is placed in the accommodating groove 3, and a gap is formed between the front end and the inner side surface due to the existence of the inclined surface.

The fourth attraction portion 11 is arranged such that, on one hand, when the earphone 2 is put into the accommodating groove 3 for a certain amount, the fourth attraction portion 11 functions to attract the earphone 2 into the accommodating groove 3. On the other hand, in a case that the external force pushes the key 4 to slide backward to allow the snapin head 5 to be separated from the clamping groove 6 and the first magnetic member to be opposite to the second magnetic member, the repulsive force between the first magnetic member and the second magnetic member ejects one end of the earphone 2 out of the accommodating groove 3, and the other end of the earphone 2 naturally swings inward. In addition, the fourth attraction portion 11 plays an attracting role on the third attraction portion 10 and attracts the other end of the earphone 2, which prevents the earphone 2 from falling out when the earphone 2 ejects out of the accommodating groove 3, and is further convenient for the taking of the user.

Specifically, the third attraction portion 10 is a third magnet, the fourth attraction portion 11 is a fourth magnet, and a magnetic pole of an inner side surface of the third magnet is opposite to a magnetic pole of an outer side surface of the fourth magnet. The inner side surface of the third magnet is a side surface opposite to the fourth magnet, the outer side surface of the fourth magnet is the above inclined surface, and the inner side surface of the third magnet and the outer side surface of the fourth magnet have opposite magnetic poles, and are able to be magnetically attracted. The third attraction portion 10 and the fourth attraction portion 11 are both arranged as magnets, and the magnetic attraction effect of the third attraction portion 10 and the fourth attraction portion 11 is more reliable. The third attraction portion 10 and the fourth attraction portion 11 may be arranged such that one uses a magnet, the other uses a member made of a material which can be magnetized such as iron, cobalt or nickel as required, which can also realize magnetic attraction.

In the above embodiments, the second attraction portion 8 is a fifth magnet, and a magnetic pole of an end of the first magnet is opposite to a magnetic pole of an end of the fifth magnet opposite to the first magnet. That is, both the first attraction portion 7 and the second attraction portion 8 adopt magnets, and the magnetic attraction effect is strong, so that the earphone 2 can be reliably stored in the device main body 1 and is not easy to fall off. Since the magnetic pole of the end of the first magnet is the same as the magnetic pole of the end of the second magnet 9 opposite to the first magnet, and is opposite to the magnetic pole of the third magnet opposite to the first magnet, so that in a case that the side surface of the first magnet facing the side surface of the second magnet 9 is an N pole, the side surface of the second magnet 9 facing the side surface of the first magnet is an N pole, the side surface of the third magnet facing the side surface of the first magnet is a S pole, or in a case that the side surface of the first magnet facing the side surface of the second magnet 9 is a S pole, the side surface of the second magnet 9 facing the side surface of the first magnet is a S pole, the side surface of the third magnet facing the side surface of the first magnet is an N pole.

On the basis of the above embodiments, an elastic member 12 is arranged between the key 4 and the device main body 1 or the earphone 2 mounted with the key 4, and the elastic member 12 is deformed in a case that the key 4 moves backward and generates a restoring force to keep the snapin head 5 in a pushed-out state. That is, the elastic member 12 is arranged between the key 4 and the device main body 1, and the external force acts on the key 4 to push it to slide backward, the elastic member 12 is deformed, and the generated restoring force pushes the key 4 to reset after the key 4 is released by the external force, and the snapin head 5 is kept in the pushed-out state and may not shake after the earphone 2 is taken out. In case of storing the earphone 2, the external force pushes the key 4 backward to make the snapin head 5 exit the clamping groove 6, so that the earphone 2 can be placed in the accommodating groove 3. Then the external force is released, and the key 4 resets under the action of the elastic member 12, so that the snapin head 5 is inserted into the clamping groove 6 to connect the earphone 2 with the device main body 1. That is, the elastic member 12 keeps the snapin head 5 in the pushed-out state, which further ensures the storage reliability of the earphone 2. The key 4 can be pushed to move without providing the elastic member 12 as required, and after the snapin head 5 is inserted into the clamping groove 6, the magnetic attraction effect of the first attraction portion 7 and the second attraction portion 8 can lock the key 4.

Further, a sliding groove is provided in the device main body 1 or the earphone 2, the key 4 includes a key body 41 and a sliding block 42 fixedly connected to the key body 41, the sliding block 42 is located in the sliding groove, the key body 41 is mounted on a surface of the device main body 1 or the earphone 2, the snapin head 5 is located at a top end of the sliding block 42, and a through hole for the snapin head 5 to pass through is provided at a top end of the sliding groove. That is, the slidable mounting of the key 4 is realized through the cooperation of the sliding groove and the sliding block 42, the sliding groove plays a guiding and limiting role for the key 4 so that the key 4 can only move back and forth along the sliding groove without falling out. Taking the key 4 mounted on the earphone 2 as an example, the key body 41 is located on an outer surface of the earphone 2, so as to facilitate operation for the user. In a case that the key 4 moves back and forth, the sliding block 42 fixedly connected to the key body 41 is driven to move back and forth along the sliding groove, so that the snapin head 5 located at the top end of the sliding block 42 extends or extracts. In order to facilitate assembly of various members, the earphone includes a housing and an end plug 43, the sliding groove is provided on the housing, and the top end is an opening, the end plug 43 is fixedly connected to an end of the housing so as to block the opening of the sliding groove. During assembly, the sliding block 42 is first assembled in the sliding groove, and then the end plug 43 is fixedly connected to the housing.

The key 4 may be specifically mounted at a tail end of an earphone handle of the earphone 2, it should be noted that the tail end is opposite to a top end of the earphone handle, and an earplug is fixed at the top end of the earphone handle. In a case where the third attraction portion 10 is provided, the third attraction portion 10 is located at the top end of the earphone handle. The accommodating groove 3 may specifically include an earphone handle portion for accommodating the earphone handle and an earplug portion for accommodating the earplug. In a case where the third attraction portion 10 is provided, the earplug portion should be reserved with an avoidance portion for the earplug to move when one end of the earphone 2 ejects out and the other end of the earphone 2 is magnetically attracted with the fourth attraction portion 11.

Specifically, the elastic member 12 is a compressed elastic member 12 with one end abutting against a bottom end of the sliding groove and the other end abutting against a bottom end of the sliding block 42. The force compressing the elastic member 12 pushes the sliding block 42 outward, so that the snapin head 5 is in an extended-out state. Alternatively, the elastic member 12 may be a tensile elastic member 12 with one end fixedly connected to a front end of the sliding block 42 and the other end fixedly connected to a front end of the sliding groove, and the snapin head 5 is also in the extended-out state. The elastic member 12 may specifically be a spring, or other elastic member or structural member capable of providing an elastic restoring force as required.

On the basis of the above embodiments, the accommodating groove 3 is arranged on a side wall of the device main body 1 in a length direction of the device main body 1. Therefore, the earphone 2 can be stored on a side surface of the device main body 1 in the length direction. With this arrangement, a space of the device main body 1 can be fully utilized, and the available space in the length direction is relatively large, which facilitates the arrangement of the earphone 2.

A front surface of the device main body 1 is provided with a display screen, and a notch of the accommodating groove 3 is located on the side surface of the device main body 1 in the length direction. This arrangement facilitates the operation for the user, and does not affect the viewing of the display screen on the front surface when taking the earphone 2.

On the basis of the above embodiments, the wrist-worn device includes two earphones, the accommodating groove 3, the key 4 and the clamping groove 6 are respectively provided in cooperation with each of the earphones 2. That is, in a case that the wrist-worn device is configured with binaural earphones 2, the accommodating groove 3 may be separately provided for each of the earphones 2 for storage, and any of the above key 4 and the clamping groove 6 may be arranged respectively for each of the earphones 2, so that each of the earphones 2 can be accessed and used separately. Preferably, the accommodating groove 3 is respectively provided on two sides of the device main body 1 in the length direction, that is, the accommodating groove 3 is respectively provided on a left side and a right side in FIG. 1, and the two earphones 2 can be stored in the two accommodating grooves 3 respectively.

In the drawings, the key 4 is slidably mounted on the earphones 2, and the clamping groove 6 and the second attraction portion 8 are arranged on the device main body 1 as an example for description. The key 4 is mounted on the earphones 2, which facilitates taking of the earphone 2 and saves the space of the device main body 1, and facilitates the layout of the second attraction portion 8. The positions of the key 4, the clamping groove 6 and the second attraction portion 8 may be reversed as required, that is, the key 4 is slidably mounted on the device main body 1, and the clamping groove 6 and the second attraction portion 8 are arranged on each of the earphones 2. The specific arrangement of other members may be arranged in the above embodiments, which will not be repeated here.

The wrist-worn device provided according to the present application may specifically be a watch or a bracelet, and its specific shape may be arranged as required, which is not limited to those shown in the drawings.

The above embodiments are described in a progressive manner. Each of the embodiments is mainly focused on describing its differences from other embodiments, and reference may be made among these embodiments with respect to the same or similar parts.

It should be further noted that the relationship terminologies such as "first", "second" and the like are only used herein to distinguish one entity or operation from another, rather than to necessitate or imply that the actual relationship or order exists between the entities or operations. Moreover, terms "comprising", "including", or any other variant thereof are intended to encompass a non exclusive inclusion such that processes, methods, articles, or devices that include a series of elements include not only those elements but also those that are not explicitly listed or other elements that are inherent to such processes, methods, articles, or devices. Unless explicitly limited, the statement "including a . . . " does not exclude the case that other similar elements may exist in the process, the method, the article or the device other than enumerated elements.

What is claimed is:

1. A wrist-worn device, comprising a device main body and an earphone, wherein an accommodating groove for placing the earphone is provided on the device main body, a key is slidably mounted on one of the device main body and the earphone, a clamping groove is provided on the other one of the device main body and the earphone, a snapin head cooperating with the clamping groove is provided at a top of the key, the key is provided with a first attraction portion, the device main body or the earphone which has the clamping groove is provided with a second attraction portion, and the first attraction portion is magnetically attracted with the second attraction portion in a case that the key slides forward until the snapin head is inserted into the clamping groove.

2. The wrist-worn device according to claim 1, wherein the first attraction portion is a first magnet, a second magnet is provided on a position of the device main body or the earphone which has the clamping groove, the position is located behind the second attraction portion and corresponds to the key sliding backward until the snapin head exits the clamping groove, and a magnetic pole of an end of the second magnet is the same as a magnetic pole of an end of the first magnet opposite to the second magnet to generate a repulsive force to push the earphone out of the accommodating groove.

3. The wrist-worn device according to claim 2, wherein the clamping groove or the key is provided on one end of the earphone, a third attraction portion is provided on the other end of the earphone, the device main body is provided with a fourth attraction portion corresponding to the third attraction portion for magnetic attraction with the third attraction portion, the third attraction portion is located on an inner side surface of the earphone, and the fourth attraction portion is located at a groove bottom of the accommodating groove, and an outer side surface of the fourth attraction portion facing the third attraction portion is an inclined surface inclined toward the third attraction portion from back to front.

4. The wrist-worn device according to claim 3, wherein the third attraction portion is a third magnet, the fourth attraction portion is a fourth magnet, and a magnetic pole of an inner side surface of the third magnet is opposite to a magnetic pole of an outer side surface of the fourth magnet.

5. The wrist-worn device according to claim 2, wherein the second attraction portion is a fifth magnet, and a magnetic pole of an end of the first magnet is opposite to a magnetic pole of an end of the fifth magnet opposite to the first magnet.

6. The wrist-worn device according to claim 1, wherein an elastic member is arranged between the key and the device main body or the earphone which is mounted with the key, and the elastic member is deformed in a case that the key moves backward and generates a restoring force to keep the snapin head in a pushed-out state.

7. The wrist-worn device according to claim 6, wherein a sliding groove is provided in the device main body or the earphone, the key comprises a key body and a sliding block fixedly connected to the key body, the sliding block is located in the sliding groove, the key body is mounted on a surface of the device main body or the earphone, the snapin head is located at a top end of the sliding block, and a through hole for the snapin head to pass through is provided at a top end of the sliding groove.

8. The wrist-worn device according to claim 7, wherein the elastic member is a compressed elastic member with one end of the compressed elastic member abutting against a bottom end of the sliding groove and the other end of the compressed elastic member abutting against a bottom end of the sliding block.

9. The wrist-worn device according to claim 1, wherein the accommodating groove is arranged on a side wall of the device main body in a length direction of the device main body.

10. The wrist-worn device according to claim 1, comprising two of the earphones, the accommodating groove, the key and the clamping groove are provided in cooperation with each of the earphones.

11. The wrist-worn device according to claim 2, wherein an elastic member is arranged between the key and the device main body or the earphone mounted with the key, and the elastic member is deformed in a case that the key moves backward and generates a restoring force to keep the snapin head in a pushed-out state.

12. The wrist-worn device according to claim 11, wherein a sliding groove is provided in the device main body or the earphone, the key comprises a key body and a sliding block fixedly connected to the key body, the sliding block is located in the sliding groove, the key body is mounted on a surface of the device main body or the earphone, the snapin head is located at a top end of the sliding block, and a through hole for the snapin head to pass through is provided at a top end of the sliding groove.

13. The wrist-worn device according to claim 3, wherein an elastic member is arranged between the key and the device main body or the earphone mounted with the key, and the elastic member is deformed in a case that the key moves backward and generates a restoring force to keep the snapin head in a pushed-out state.

14. The wrist-worn device according to claim 13, wherein a sliding groove is provided in the device main body or the earphone, the key comprises a key body and a sliding block fixedly connected to the key body, the sliding block is located in the sliding groove, the key body is mounted on a surface of the device main body or the earphone, the snapin head is located at a top end of the sliding block, and a through hole for the snapin head to pass through is provided at a top end of the sliding groove.

15. The wrist-worn device according to claim 4, wherein an elastic member is arranged between the key and the device main body or the earphone mounted with the key, and the elastic member is deformed in a case that the key moves backward and generates a restoring force to keep the snapin head in a pushed-out state.

16. The wrist-worn device according to claim 15, wherein a sliding groove is provided in the device main body or the earphone, the key comprises a key body and a sliding block fixedly connected to the key body, the sliding block is located in the sliding groove, the key body is mounted on a surface of the device main body or the earphone, the snapin head is located at a top end of the sliding block, and a through hole for the snapin head to pass through is provided at a top end of the sliding groove.

17. The wrist-worn device according to claim 5, wherein an elastic member is arranged between the key and the device main body or the earphone mounted with the key, and the elastic member is deformed in a case that the key moves backward and generates a restoring force to keep the snapin head in a pushed-out state.

18. The wrist-worn device according to claim 17, wherein a sliding groove is provided in the device main body or the earphone, the key comprises a key body and a sliding block fixedly connected to the key body, the sliding block is located in the sliding groove, the key body is mounted on a surface of the device main body or the earphone, the snapin head is located at a top end of the sliding block, and a through hole for the snapin head to pass through is provided at a top end of the sliding groove.

* * * * *